US007044453B2

(12) United States Patent
Tharp

(10) Patent No.: US 7,044,453 B2
(45) Date of Patent: May 16, 2006

(54) MEMBRANE DIFFUSER WITH UNIFORM GAS DISTRIBUTION

(75) Inventor: Charles E. Tharp, Columbia, MO (US)

(73) Assignee: Environmental Dynamics, Inc., Columbia, MO (US)

( * ) Notice: Subject to any disclaimer, the term of this patent is extended or adjusted under 35 U.S.C. 154(b) by 65 days.

(21) Appl. No.: 10/753,677

(22) Filed: Jan. 8, 2004

(65) Prior Publication Data

US 2005/0151281 A1 Jul. 14, 2005

(51) Int. Cl.
*B01F 3/04* (2006.01)

(52) U.S. Cl. ..... 261/122.1; 261/122.2; 261/DIG. 70

(58) Field of Classification Search ..... 261/122.1, 261/124, 122.2, DIG. 70; 210/220, 221.2
See application file for complete search history.

(56) References Cited

U.S. PATENT DOCUMENTS

| | | | | | |
|---|---|---|---|---|---|
| 3,970,731 | A * | 7/1976 | Oksman | 261/122.1 |
| 4,165,286 | A * | 8/1979 | Schreiber et al. | 210/220 |
| 4,243,521 | A | 1/1981 | Tharp et al. | |
| 4,563,277 | A | 1/1986 | Tharp | |
| 4,581,137 | A * | 4/1986 | Edwards et al. | 210/220 |
| 4,842,732 | A | 6/1989 | Tharp | |
| 4,954,296 | A * | 9/1990 | Ott | 261/122.2 |
| 4,960,546 | A | 10/1990 | Tharp | |
| 5,032,325 | A | 7/1991 | Tharp | |
| 5,059,358 | A | 10/1991 | Tharp | |
| 5,133,876 | A | 7/1992 | Tharp | |
| 5,851,448 | A * | 12/1998 | Tyer | 261/122.1 |
| 6,260,831 | B1 * | 7/2001 | Jager | 261/122.1 |
| 6,543,753 | B1 | 4/2003 | Tharp | |
| 6,626,425 | B1 * | 9/2003 | Ott | 261/122.1 |
| 2002/0043729 | A1 * | 4/2002 | Ott | 261/122.1 |

* cited by examiner

*Primary Examiner*—Scott Bushey
(74) *Attorney, Agent, or Firm*—Blackwell Sanders Peper Martin LLP

(57) ABSTRACT

A flexible diffuser membrane is provided with a unique system of perforations arranged to result in uniform distribution of gas even though the membrane deflects to different extents or the submergence varies in different parts of the membrane. The perforations are arranged to provide less perforation area per unit of perforated membrane surface area in the membrane parts that deflect the most or are submerged least and greater perforation area in membrane parts that deflect the least or are submerged most. The perforations can be slits arranged in parallel rows on a tubular membrane, in concentric circles or another pattern on a disk membrane, or in still a different pattern on a flat panel diffuser membrane. The slit length or separation can be varied between different zones on the membrane surface or the spacing between rows or circles can be varied.

20 Claims, 4 Drawing Sheets

MEMBRANE DIFFUSER WITH UNIFORM GAS DISTRIBUTION

FIELD OF THE INVENTION

This invention relates generally to the diffusion of gases into liquids and deals more particularly with membrane diffusers which discharge gas into a liquid in the form of fine bubbles.

BACKGROUND OF THE INVENTION

In the various applications for diffusing gas into liquids, such as in the aeration of wastewater, it is known that the highest efficiency is achieved when the gas is released as fine bubbles. The efficiency in transferring oxygen or another gas to the liquid is enhanced by maximizing the bubble surface area compared to the volume. Consequently, the gas transfer efficiency increases directly with decreasing bubble diameter, so fine bubbles result in a more efficient process.

Fine bubble technology has made use of tube diffusers that include a flexible membrane sleeved onto a tube diffuser body and provided with small perforations for discharging the gas into the liquid. When gas pressure is applied inside of the membrane, the membrane is expanded and the perforations open to discharge gas through them in the form of fine bubbles. When the gas pressure is relieved, the membrane collapses on the diffuser body and creates a seal that prevents liquid from leaking into the diffuser tubes. An example of a tubular membrane diffuser of this type is found in U.S. Pat. No. 4,960,546 to Tharp.

Disk and panel diffuser units have also been used in the aeration of wastewater and other gas diffusion operations. In a disk or panel diffuser, a flexible membrane overlies a chamber in the diffuser body and expands when gas pressure is applied to the chamber. Perforations in the membrane then open to discharge fine bubbles of gas. The perforations close when the gas pressure is relieved, and the membrane collapses onto the base of the air chamber or backer plate.

The panel diffuser makes use of a flat membrane bonded or otherwise secured to a frame which provides a plenum beneath the membrane. The membrane typically has perforations arranged in rows for discharge of the gas supplied to the plenum. The panel diffuser is functionally similar to the disk diffuser and differs principally in that it has a rectangular geometry rather than a round disk shape as is the case with a disk diffuser.

Although these membrane diffusers function well for the most part, they are not wholly free of problems. When gas pressure is applied, the membranes deflect unevenly. In the disk and panel, the membrane is fixed at its outer edges, so there is a dome effect created with the center of the membrane being at a higher elevation than the rim area. The perforations near the center discharge more gas because they are submerged to a lesser extent than the rim and thus subjected to a reduced static pressure head. The uniformity of the air distribution thus suffers, and the gas transfer efficiency decreases with the decrease in the uniformity of the gas distribution over the surface of the membrane. The greater deflection of the center area of the membrane may also result in the perforations there opening to a greater extent, and this may aggravate the lack of uniform gas release. Panel diffusers are subject to the same problems as disk diffusers as to the non-uniformity of the gas distribution caused primarily by the differential in elevation between the center area and the edge areas when the membrane is deflected less than the center area.

Due to the ability of a tubular shape to resist stress, there is little deflection in a tubular membrane. Nevertheless, the top of the tube is at a higher elevation and subject to less pressure head, so it discharges more gas than the bottom or sides. Again, this detracts from the uniformity of the distribution over the membrane surface and results in a lower gas transfer efficiency than in the case of more uniform distribution.

This non-uniformity has been partially addressed in disk diffusers by tapering the membrane such that its thickness decreases toward the outer edges. The resistance to gas flow through the perforations is thereby decreased near the edges and counteracts to some extent the effect of the greater deflection at the center. However, non-uniformities are still present and this technique has not completely solved the problem.

Tubular membranes are most efficiently manufactured using an extrusion process, so the tubular membrane cannot be tapered as readily as a disk membrane which is normally molded. The thickness of a tubular membrane is normally constant around its entire circumference. The non-uniformity of air distribution in a tubular membrane can be reduced by creating a large pressure drop across the membrane to force a more uniform distribution. However, this results in significant added energy consumption which can increase the operating costs to unacceptable levels. Therefore, the choices have been either to operate the diffuser with poor distribution or create a large head loss, neither of which is desirable from a performance or energy efficiency standpoint.

Uniform air distribution is desirable because it results in an even discharge of gas through all of the perforations. This in turn results in small gas bubbles which enhance the efficiency of gas transfer to the liquid. By using all of the perforations and uniform gas discharge through them, the gas transfer efficiency is maximized. Therefore, the number of diffusers required for a given process is minimized to reduce the equipment requirements while maintaining the required gas transfer to the liquid.

BRIEF SUMMARY OF THE INVENTION

It is the principal goal of the present invention to provide a flexible membrane that is constructed to enhance the uniformity of distribution of gas to a liquid in a diffusion process in order to increase the gas transfer efficiency.

More specifically, it is an important object of the invention to provide, in a tubular diffuser, a diffuser membrane that has decreased perforation area in the part of the membrane that is subject to increased deflection or highest elevation.

Another and similar object of the invention is to provide a disk diffuser membrane or a flat panel membrane that has a decreased perforation area toward the center of the membrane where the deflection is greater.

A further object of the invention is to provide a diffuser membrane of the character described in which the perforation area per unit of surface area on the membrane can be controlled in a variety of ways, including controlling the length of the membrane slits in different zones on the membrane, controlling the separation between adjacent slits, and controlling the spacing between adjacent rows of slits, circles of slits or other slit patterns, as well as other ways of achieving the desired result.

Yet another object of the invention is to provide a diffuser membrane of the character described which can be constructed in a simple and economical manner, which functions reliably over an extended operating life, and which can be used in various types, sizes and shapes of gas diffusers.

In accordance with the invention, an improved membrane is constructed in a manner to enhance the uniformity of gas distribution provided by a tubular disk or panel membrane. In a preferred embodiment of the invention, the areas of the membrane that are at the highest elevation are provided with the least total perforation area per unit area of the membrane. As a consequence, the gas discharge in these areas is more closely balanced with the gas discharge in the areas of the membrane that are subjected to a larger hydraulic head. The result is that the gas is distributed more uniformly throughout the entire area of the membrane, and the efficiency of the gas transfer is increased accordingly.

In the case of the tubular membrane, the circular cross-section of the membrane may be zoned into a first zone that occupies an arc centered at a north pole location on the membrane and at least two other zones occupying arcs located adjacent to the ends of the first zone. The perforations may be formed in spaced apart rows of slits, with the slits in each row spaced apart end to end and the rows spaced apart from one another (or another slit arrangement can be used). In the first zone which is deflected the most, the slits collectively occupy an area that is less per unit area on the membrane than is occupied by the slits in the other zones. This makes the gas discharge more uniform throughout the surface area of the membrane. The slits in the first zone can be made shorter or spaced further from adjacent slits, or the rows can be spaced further apart, or any combination of these techniques can be used to create a lesser overall percentage of the first zone that is occupied by the slits there. In the case of other perforation patterns, the perforations can be arranged to provide a greater collective area per unit membrane area in the lower parts of the membrane, thus enhancing the uniformity of the air discharge.

In a disk diffuser application, the membrane may be zoned into a first circular zone centered at the geometric center of the disk and at least one annular zone outside of the first zone. The slits may be arranged in concentric circles in each zone. The outer zone can have its slits occupy a larger part of the surface area per unit of perforated membrane thereby making the slits longer in the outer zone, spacing the slits closer together in each circle, or spacing the circles of slits closer together.

Another perforation pattern that can be used with a disk diffuser membrane involves arranging the membrane surface into separate pie shaped sectors (six sectors is one possibility). Each sector is then provided with a plurality of slits which may be arranged in straight rows each including slits spaced apart end to end. Randomly arranged perforations are also possible. In accordance with the invention, zones of perforations closer to the center are provided with less total perforated area per unit of membrane area than the zones from the center, irrespective of how the perforations are arranged on the membrane.

Similarly, panel diffusers however constructed have zones of perforations near the center that present less total perforation area per unit of membrane area than perforation zones that are more distant from the center. Again, the particular shape and/or arrangement of the perforations is not important but the creation of zones that differ in the perforation area density is.

The membrane construction of this invention results in optimum distribution of gas, uniformity of gas discharge across the membrane surface, optimum pressure drop across the membrane thickness, and maximum efficiency in the transfer of gas to a liquid.

Other and further objects of the invention, together with the features of novelty appurtenant thereto, will appear in the course of the following description.

BRIEF DESCRIPTION OF THE SEVERAL VIEWS OF THE DRAWING

In the accompanying drawings which form a part of the specification and are to be read in conjunction therewith and in which like reference numerals are used to indicate like parts in the various views.

DETAILED DESCRIPTION OF THE INVENTION

Figure 1:
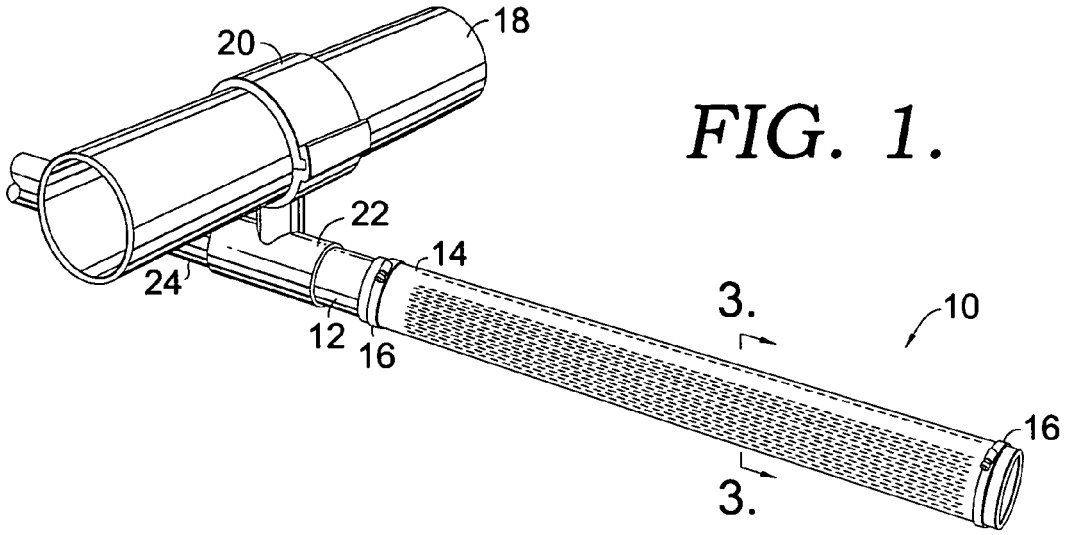
FIG. 1 is a fragmentary perspective view of a tubular membrane diffuser constructed in accordance with a preferred embodiment of the present invention mounted on an air supply pipe.

Referring now to the drawings in more detail and initially to FIG. 1, numeral 10 generally designates a tubular membrane diffuser constructed according to one embodiment of the present invention. The diffuser 10 includes a rigid cylindrical pipe 12 and a cylindrical membrane 14 which is sleeved closely around the pipe 12 and secured in place to the pipe by hose clamps 16 applied to the opposite end portions of the membrane 14, or by some other suitable means. The diffuser body or pipe 12 may be constructed of PVC or another suitable material.

Figure 3:
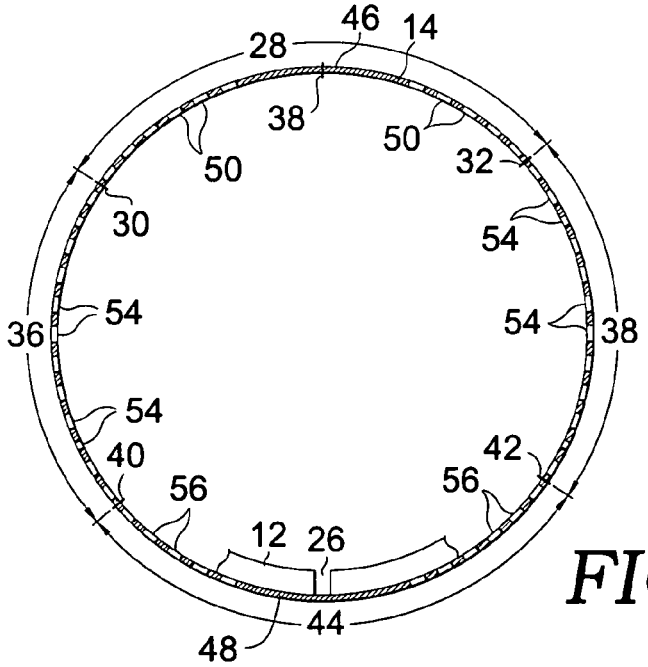
FIG. 3 is a fragmentary cross-sectional view on an enlarged scale taken generally along line 3—3 of FIG. 1 in the direction of the arrows.

In a typical application, the diffuser 10 is supplied with air or another gas from a submerged supply pipe 18 to which the gas is supplied by a fan or blower (not shown). A saddle structure 20 may be clamped onto the supply pipe 18 and provided with an outlet that applies the gas to the inlet of a tee fitting 22 suitably secured to the saddle 20. The diffuser pipe 12 is secured in one outlet of the tee fitting, and a similar diffuser pipe 24 is connected with the other outlet of the tee fitting and equipped with a membrane (not shown) that may be identical to the membrane 14. In this manner, the diffusers 10 may be installed in a duplex arrangement. The gas is supplied from the pipe 18 to the tee fitting 22 and then to the interior of the diffuser pipes 12 and 24. As shown in FIG. 3, the gas is supplied from the interior of the pipe 12 to the inside of the membrane 14 through one or more ports 26 that are formed in the pipe 12, preferably at a south pole location at the bottom of pipe 12.

The membrane 14 is constructed of a flexible material such as rubber, neoprene, urethane or a synthetic material having the requisite flexibility and structural characteristics. The diffuser membrane 14 is provided with a plurality of perforations which, when there is no gas pressure applied, are closed due to the collapsing of the membrane 14 closely onto the outside surface of the diffuser pipe 12. When gas is applied to the inside of the membrane, the gas pressure expands the membrane 14 and deflects it outwardly such that the perforations open and discharge the gas into the surrounding water or other liquid in the form of fine bubbles. The discharge of the gas in small bubbles enhances the efficiency of the transfer of gas to the liquid and thus enhances the efficiency of the diffusion process.

In accordance with one embodiment of the present invention (a tubular membrane perforated both top and bottom), the perforations in the membrane 14 are specially arranged in order to more uniformly distribute the gas over the entire surface area of the membrane. With reference to FIG. 3 in particular, the circumference of the membrane 14 is divided into a plurality of different zones which each occupy a selected arc on the membrane circumference. A first zone identified by numeral 28 in FIG. 3 occupies an arc extending between the locations 30 and 32 which are spaced equidistantly from a north pole location 34 at the top of the membrane 14. The first zone 28 is centered on the north pole location 34. The zone 28 may occupy an arc, typically extending through one-fourth or 90° on the circumference of the membrane 14.

A pair of second zones identified by numeral 36 and 38 in FIG. 3 extend respectively between points 30 and 40 and points 32 and 42. The zones 36 and 38 are opposite to one another on opposite sides of the diffuser membrane 14 and may extend through arcs such as 90° each. The zones 36 and 38 are adjacent to the opposite ends of zone 28 and may be centered at locations corresponding to the equator of the circular cross-section of the membrane 14. Another zone 44 may be provided at the bottom of the membrane 14 to occupy an arc of approximately 90° extending between points 40 and 42. The zone 44 may be centered at the location of the ports 26 which corresponds with the south pole location of the circular membrane 14. Each of the zones 28, 36, 38 and 44 extends along substantially the entire length of the diffuser membrane 14, and each zone is provided with perforations having a special pattern to create uniformity of gas distribution over the entire perforated surface area when gas discharges through the perforations in operation of the diffuser 10.

Figure 2:
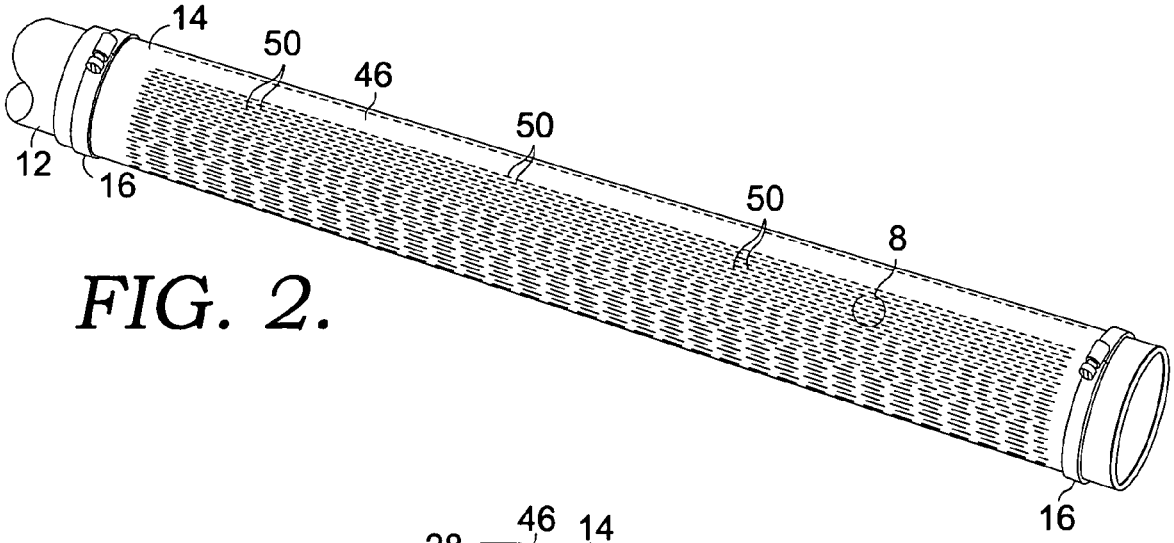
FIG. 2 is a fragmentary perspective view on an enlarged scale of the diffuser shown in FIG. 1.

As best shown in FIGS. 2 and 3 (for "tube" aerators), the first zone 28 may be imperforate in a strip 46 extending along the top of the membrane 14 adjacent to and on opposite sides of the north pole location 34. Another imperforate strip 48 (FIG. 3) may be provided at the bottom of the diffuser in zone 44. The strip 48 may extend adjacent to and on opposite sides of the location of the ports 26 at a south pole position on the membrane in a membrane that is perforated top and bottom.

Figure 10:
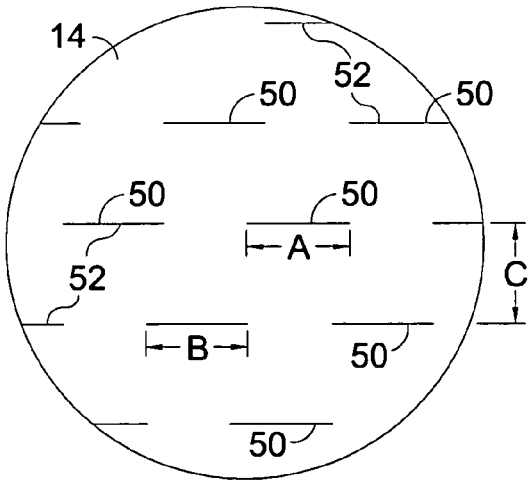
FIG. 10 is a fragmentary view on an enlarged scale of the detail indicated by numeral 8 in FIG. 2.

The first zone 28 is provided with a plurality of perforations 50. As best shown in FIG. 10, the perforations 50 may take the form of slits that may be arranged in parallel rows 52 of slits. Each row 52 may extend parallel to the longitudinal axis of the membrane 14 and may include a plurality of slits that may be arranged end to end and spaced apart from one another. In FIG. 10, the dimension A represents the length dimension of each of the slits 50. The dimension B represents the separation between the ends of adjacent slits in each row. The dimension C represents the distance between each adjacent pair of rows 52. The slits may be arranged in other patterns, including randomly, and the perforations may have shapes other than slits.

The zones 36 and 38 are also provided with perforations 54 which may take the form of slits arranged similarly to the perforations 50. The final or third zone 44 similarly may include perforations 56 which may be arranged as slits spaced apart in separate parallel rows in substantially the same manner shown in FIG. 10.

In accordance with the present invention, the slits 50 (or other perforations) are formed such that the collective area they occupy as a percentage of the total perforated area in zone 28 is less than the area collectively occupied by slits 54 (or other perforations) as a percentage of the total perforated surface area in each of the second zones 36 and 38. The slits 56 (or other perforations) formed in the third or lower zone 44 collectively occupy an area that is less as a percentage of the total perforated area of zone 44 than is occupied collectively by the slits 54 (or other perforations) in zones 36 and 38.

The provision of slits or other perforations in the different zones that occupy more or less area in their particular zone can be accomplished in different ways. By way of example, FIG. 2 depicts a membrane 14 in which the slits 50 in the first zone 46 are each shorter than the slits 54 formed in the second zones 36 and 38. The slits 56 in the third zone 44 are longer than the slits 54. Because the slits 54 are longer than slits 50, the slits 54 collectively occupy a greater percentage of the perforated surface area in zones 36 and 38 than the slits 50 occupy as a percentage of the total perforated surface area in zone 28.

Alternatively, the separation dimension between slits (the dimension B in FIG. 10) can be greater in zone 28 than in zones 36 and 38 and greater in zones 36 and 38 than in zone 44. By providing slits that are the same length in all the zones but differ in their separation, the slits 54 occupy more of the perforated area in zones 36 and 38 than is occupied by slits 50 as a percentage of the total perforated area in zone 28.

Another alternative is to make the distance between adjacent rows (the distance C in FIG. 10) greater in zone 28 than in zones 36 and 38 and greater in zones 36 and 38 than in zone 44. Again, this results in the area collectively occupied by slits 54 as a percentage of the total perforated area in zones 36 and 38 being greater than the area occupied by slits 50 as a percentage of the total perforated area in zone 28.

As a result of constructing the membrane 14 in any of these fashions, the zone that deflects the most, zone 28, has a greater elevation or lesser submersion when the gas is applied than zones 36 and 38 which deflect to a lesser extent and thus have a lower elevation. Likewise, zone 44 deflects even less than zones 36 and 38 but has perforations 56 that represent a larger percentage of the surface area. As a result, the gas discharging from each unit area of the first zone 28 is substantially equal in volume to the amount of gas discharging from the unit areas of other zones 36, 38 and 44. The uniformity of the gas discharged over the surface area of membrane 14 is thus enhanced. The zone or zones that deflect the most also may have their perforations open to a greater extent to present more perforation exposure which may tend to increase the gas discharge.

By way of example, in a situation where the slit length varies from zone to zone, the perforations 50 can be approximately 0.5 millimeter long each, the perforation length in zones 36 and 38 can be approximately 0.75 millimeter, and the perforation length in zone 44 can be approximately 1 millimeter. The spacing between adjacent slits can be between 1 and 1.5 millimeters, and the spacing between adjacent rows can be approximately 2.7 millimeters. Alternatively, the slit length in all of the zones can be approximately the same such as 0.75 millimeters, with the row spacing being about 2.7 millimeters in each zone with the separation between slits varying from zone to zone (such as the distance B being approximately 1 millimeter in zone 28, approximately 0.75 millimeter in zones 36 and 38 and approximately 0.5 millimeter in zone 44. The row spacing can also vary among the zones with the slit length and slit separation being substantially the same in each zone. It should be recognized that any combination of slit length, separation and row spacing can be used to achieve the overall result of substantially uniform distribution of the gas around the entire circumference of the membrane 14. It should also be recognized that a larger or fewer number of zones can be provided and that the zones can each occupy virtually any desired arc on the circumference of the membrane.

Figure 4:
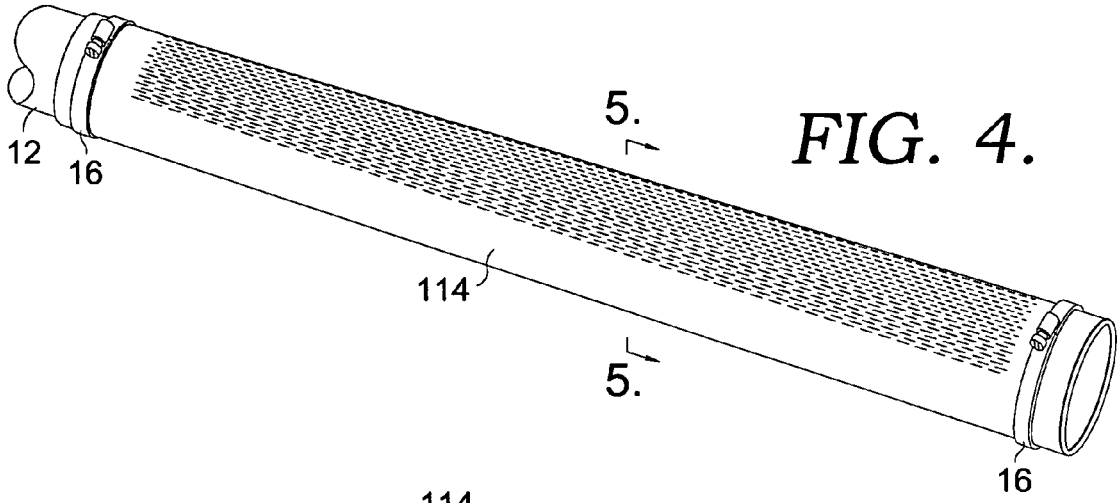
FIG. 4 is a fragmentary perspective view similar to FIG. 2, but showing a diffuser having a modified membrane constructed according to another embodiment of the present invention.
Figure 5:
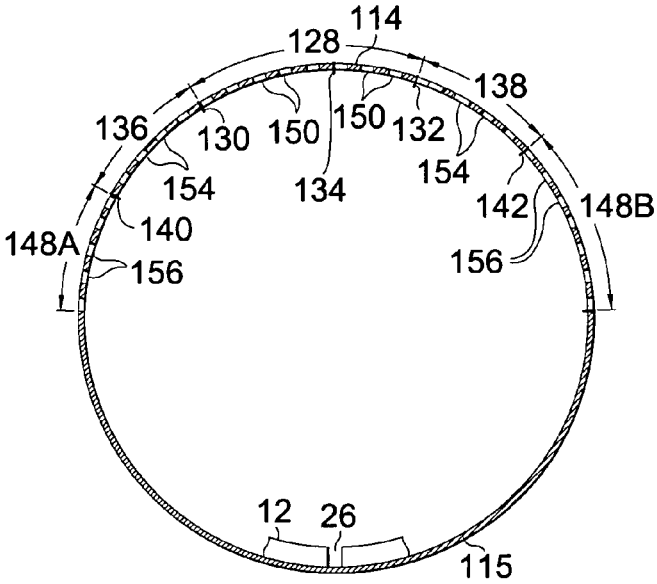
FIG. 5 is a fragmentary sectional view on an enlarged scale taken generally along line 5—5 of FIG. 4 in the direction of the arrows.

FIGS. 4 and 5 show an alternative membrane 114 which is constructed similarly to membrane 14 for the most part. The principal difference is that the membrane 114 is perforated only in its top portion or its upper hemisphere which is approximately the top 180° on the circumference of the membrane. The lower hemisphere 115 may be imperforate.

As shown in FIG. 5, the membrane 114 may have a first zone 128 that occupies an arc on the top portion of the membrane extending between the points 130 and 132. The zone 128 may be centered on and extend equal distances on opposite sides of the north pole location 134. A pair of second zones 136 and 138 may be formed adjacent to the opposite ends of zone 128, with zone 136 extending between points 130 and 140 and zone 138 extending between points 132 and 142. A pair of third zones 148A and 148B may be adjacent to the ends of the respective zones 136 and 138. Zone 148A may extend from point 140 to the edge of the lower hemisphere 115. Zone 148B may extend from point 142 to the adjacent edge of the lower hemisphere 115. Each of the zones 128, 136, 138, 148A and 148B may occupy an arc of approximately 36° (or any other suitable combination of areas) so that the zones collectively occupy approximately the upper 180° of the membrane circumference. It should be understood that this specific number of zones and their arrangement is exemplary only and that virtually any number of zones greater than one may be provided.

Zone 128 may be provided with perforations 150, zones 136 and 138 may be provided with perforations 154, and zones 148A and 148B may be provided with perforations 156. The perforations 150, 154 and 156 may be arranged as slits in a pattern where the slits are arranged in parallel rows and spaced apart in each row end to end in the manner shown in FIG. 10.

The perforations 150 collectively occupy a lesser area as a percentage of the total perforated surface area in zone 128 than is occupied collectively by the perforations 154 as a percentage of each of the second zones 136 and 138. Similarly, the perforations 154 occupy collectively an area that is less as a percentage of the total perforated area in zones 136 and 138 than is occupied by the perforations 156 as a percentage of each of the third zones 148A and 148B. This can be accomplished in any of the ways detailed previously for membrane 14 or in any other suitable way.

When the membrane 114 is in service, the gas distribution around the perforated upper hemisphere of the membrane is substantially uniform throughout the entire perforated part of the membrane by reason of the size and arrangement of the perforations 150, 154 and 156. As a result, as with the membrane 14, the gas is transferred efficiently to the liquid into which the gas is diffused.

Figure 6:
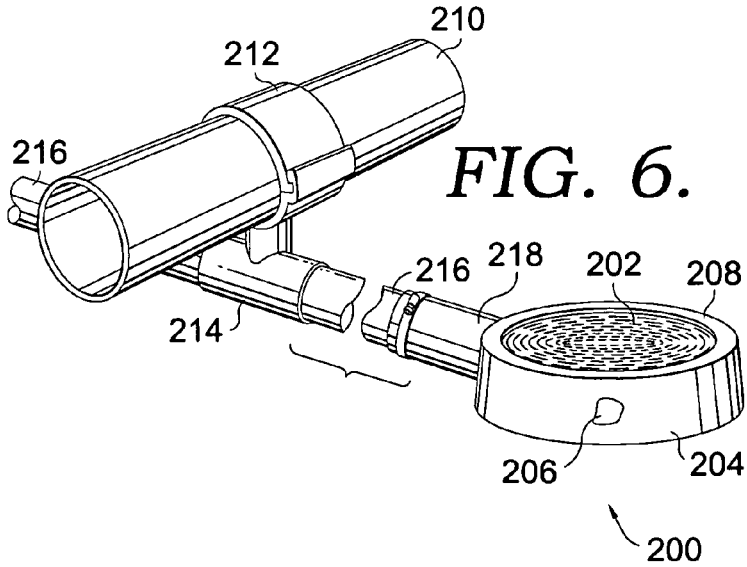
FIG. 6 is a fragmentary perspective view showing a disk diffuser constructed in accordance with another embodiment of the present invention connected with a gas supply pipe.
Figure 7:
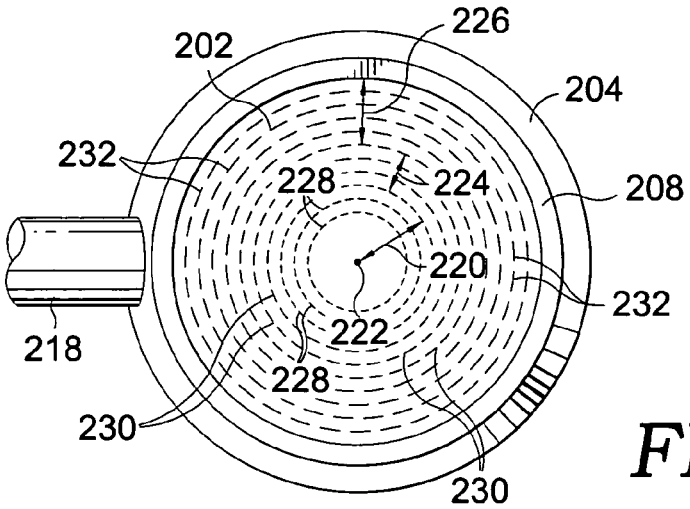
FIG. 7 is a fragmentary top plan view on an enlarged scale of the disk diffuser and membrane shown in FIG. 6.

FIGS. 6 and 7 depict a disk diffuser 200 that is provided with a flexible disk membrane 202 constructed in accordance with an alternative embodiment of the present invention. The diffuser 200 includes a rigid diffuser body 204 having a plate or other structure 206 on which membrane 202 lies flat until gas is applied. The structure 206 has an opening that applies gas to the underside of the flexible membrane 202, thereby deflecting the membrane upwardly for discharge of gas. The membrane 202 may be secured to the top of the diffuser body 204 by a ring 208 which secures the circular peripheral edge or rim of the membrane 202 to the rim of the diffuser body 204. When gas pressure is applied through the opening in structure 206, the membrane 202 is deflected upwardly by the gas pressure, most pronouncedly in the center portion of the membrane and progressively to a lesser degree from the center outwardly toward the peripheral edge or rim of the membrane.

Gas can be applied to the diffuser 200 in any suitable way. As shown in FIG. 6, a submerged supply pipe 210 may receive gas from a fan or blower (not shown). A saddle structure 212 may be secured to the pipe 210 and provided with an outlet that supplies gas from the pipe 210 into a tee fitting 214. The outlets of the tee fitting 214 connect with pipes or hoses 216. One of the hoses 216 connects with an inlet 218 of the diffuser body 204 leading to the chamber 206. The diffuser 200 may rest on or near the floor of a tank, lagoon or basin containing liquid into which the gas is to be diffused. As an alternative to the arrangement shown in FIG. 6, the diffuser 200 may be mounted above the supply pipe 210 using any suitable structure such as the saddle structure 212 on a similar structure.

With reference to FIG. 7 in particular, the surface of the membrane 202 may be arranged to provide a first zone indicated by numeral 220. The first zone 220 may be circular and may be centered at the geometric center point 222 of the disk shaped membrane 202. Immediately outwardly of the first zone 220, a second zone 224 may be provided on the membrane 202. Zone 224 may be annular and may be located adjacently outwardly of zone 220 at a centered position on the point 222. A third zone 226 may be located adjacently outwardly from zone 224. Zone 226 may be an annular zone centered on the center point 222 and may extend from the outer perimeter of zone 224 to the outer edge of membrane 202.

Zone 220 is provided with a plurality of perforations 228. The perforations 228 are arranged in concentric circles, each including a plurality of the perforations that may be in the form of slits which may be spaced apart in an end to end arrangement in each circle. The slits can be slightly arcuate or straight. The circles that contain the perforations 228 are centered on the center point 222. The second zone 224 may similarly be provided with perforations 230 which may likewise be arranged in concentric circles each containing a plurality of slits spaced apart end to end. The third zone 226 may have perforations 232 arranged in concentric circles each containing a plurality of slits spaced apart end to end.

In accordance with the present invention, the area collectively occupied by slits 228 as a percentage of the total perforated area in zone 222 is less than the area collectively occupied by the slits 230 as a percentage of the total perforated area in zone 224. The area collectively occupied by slits 232 as a percentage of the total perforated area in zone 226 is greater than the area collectively occupied by slits 230 as a percentage of the total perforated area in zone 224.

As with the embodiments shown in FIGS. 1–3 and 4–5, this result can be achieved in several ways. First, as shown in FIG. 7, the slits 228 can be made shorter than the slits 230, and slits 230 can be made shorter than the slits 232. Alternatively, the slits 228 can be spaced farther apart from one another in each row than the slits 230, and the slits 230 can be spaced farther apart than the slits 232. Another way of achieving the desired result is to space the circles of slits mores widely apart in zone 220 than in zone 224 and more widely in zone 224 than in zone 226. There are other ways that are possible to achieve the desired result.

Whichever way the perforations are arranged, the result is that the center area of the membrane 202 occupied by the first zone 220 deflects the most and is at the highest elevation when air is applied and has the smallest area occupied by the perforations 228 as a percent of the total perforated area. Conversely, the outer zone 226 deflects the least and is provided with the most unit area of perforations as a percent of the total area occupied by the perforations 232. Thus, substantially equal amounts of air are discharged from each unit area of each of the zones, and the overall uniformity of the air distribution across the entire perforated surface area of the membrane 202 is made substantially uniform. Consequently, the efficiently of the gas transfer to the liquid is maximized by virtue of the special construction of the membrane 202 and the arrangement of the perforations.

Figure 8:
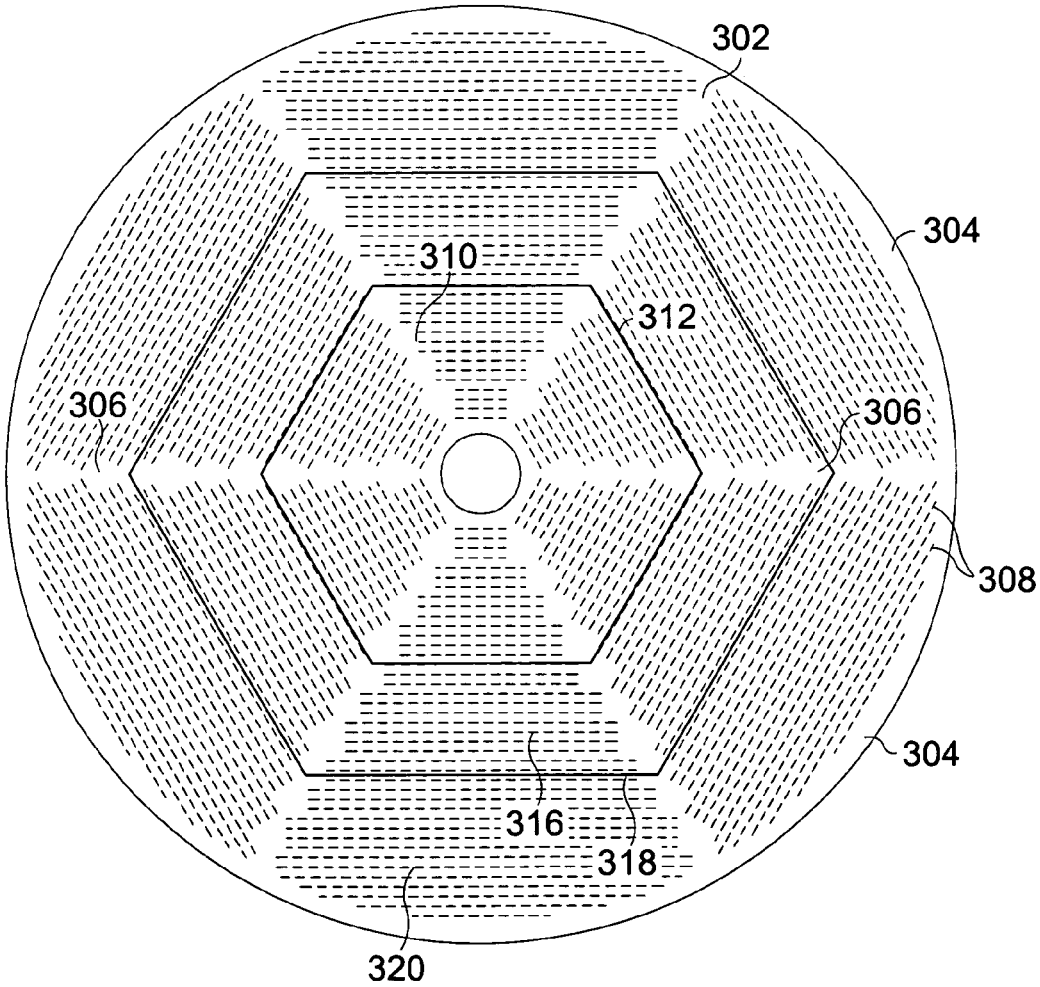
FIG. 8 is a top plan view of a disk diffuser membrane constructed according to still another embodiment of the invention, with the membrane having separate pie shaped sectors each having slits arranged in rows.

FIG. 8 depicts a flexible disk membrane 302 that may be used with a disk diffuser such as the diffuser 200 in place of membrane 202. The membrane 302 is divided into a plurality of separate sectors 304 that are shaped in the manner of pieces of pie and separated from one another by imperforate strips 306 extending along radii of the membrane 302. Each of the sectors 304 is provided with a plurality of perforations which may take the form of slits 308. The slits 308 in each row may be spaced apart end to end. The rows of slits 308 in each sector 304 extend parallel to a line that is tangent to the periphery of the sector at its center.

In accordance with the present invention, the membrane 302 may be divided into a plurality of zones. One possible arrangement of zones includes a first zone 310 which is located inside of a hexagonal line 312 formed about the center point 314 of the membrane 302. At least one additional zone 316 is located outwardly of the line 312 and inwardly of another line 318 which may be a hexagonal line concentric with line 312 or a circular line formed by the outer edge of the membrane. In this manner, the zones 310 and 316 are arranged with zone 310 located inwardly of zone 316 and the zones formed by concentric polygons. In the case of a membrane having six of the sectors 304, the polygons take the form of hexagons, but other numbers of sectors and other polygonal shapes are possible. A third zone 320 may be formed outwardly of line 318 and may extend to the circular periphery of the membrane 302. Each of the zones 310, 316 and 320 is provided with a plurality of the slits 308 (or other perforations).

In accordance with the present invention, the area collectively occupied by the slits located in zone 310 has a percentage of the total perforated area in zone 310 is less than the area collectively occupied by the slits has a percentage of the total perforated area in zone 316. The area collectively occupied by the slits as a percentage of the total perforated area in zone 320 is greater than the area collectively occupied by the slits 308 as a percentage of the total perforated area in zone 320. This result can be achieved in the ways described previously in connection with the other embodiments of the invention or in other ways.

When air is applied to the membrane 304, the center zone 310 deflects upwardly to a greater extent than zone 316 which in turn deflects upwardly to a greater extent than zone 320. Because the zone 310 which deflects the most and is thus at the highest elevation has the smallest area of slits as a percent of total area occupied by the perforations, and the zone 320 which deflects the least and is thus at the lowest elevation has the largest area of slits as a percent of total area occupied by the perforations, the result is that substantially equal amounts of air are discharged from each unit area of each of the zones. Consequently, the overall uniformity of the air distribution across the entire perforated surface area of the membrane 302 is made substantially uniform. This results in maximum efficiency of the gas transfer to the liquid due to the arrangement of the perforations.

Figure 9:
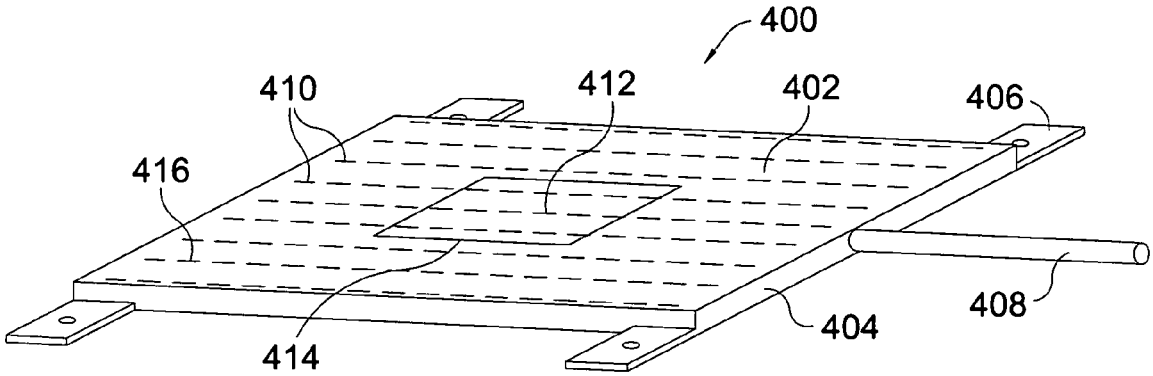
FIG. 9 is a diagrammatic perspective view of a panel diffuser having a membrane perforated according to yet another embodiment of the invention.

FIG. 9 depicts a panel diffuser which is generally identified by numeral 400 and which includes a flexible membrane 402 which is substantially flat and secured at its periphery to a diffuser frame or body 404. The diffuser body 404 may have feet 406 that allow it to be anchored directly to the floor of a tank or basin, or the diffuser may be installed in the tank or basin in another known manner. An air supply pipe 408 leads to the diffuser body 404 and may receive air or another gas under pressure from a suitable source such as a blower or fan (not shown). The flat membrane 402 is normally collapsed on a support in the diffuser body 404. However, when gas is applied, the gas acts against the underside of the membrane 402 through a suitable opening in its support, and the membrane 402 then expands upwardly, except at its periphery where it is bonded or otherwise suitably secured to the diffuser body 404. The membrane 402 is provided with a plurality of perforations which may take the form of slits 410 that open when the membrane is expanded due to the application of gas pressure, with the gas being discharged into the liquid through the slits 410.

The slits 410 may be arranged in any suitable manner on the membrane 402, including randomly or in parallel rows of slits as depicted in FIG. 9, with the slits in each row being spaced apart end to end.

In accordance with the present invention, the membrane 402 is provided with a plurality of zones. This may be accomplished by forming a first zone 412 within a rectangular line 414 having sides parallel to the edges of the diffuser membrane 402. At least one additional zone 416 is formed on membrane 402 and may be located outside of line 414 and inside of the periphery of the membrane. The zones 412 and 416 are thus formed by concentric rectangles (the rectangle formed by line 414 and the rectangle formed by the peripheral edges of the diffuser membrane 402). Additional zones can be provided by forming one or more additional concentric rectangles, and it is to be understood that the zones can be formed in other ways.

The area collectively occupied by the slits 410 as a percentage of the total perforated area in zone 412 is less than the area collectively occupied by the slits located in zone 416 as a percentage of the total area in zone 416. This result can be achieved in any of the ways previously described or in any other suitable way.

When gas is applied to the membrane 402, its center area deflects upwardly to a greater extent than the remainder of the membrane and is thus at a higher elevation. Because zone 412 is closest to the center of the membrane, it deflects the most and is at the highest elevation. The center zone 412 has the smallest area occupied by the perforations per unit of perforated surface area, whereas the outer zone 416 has the largest area occupied by the perforations per unit perforated area. The overall result is that substantially equal amounts of air are discharged from each unit of perforated area of each of the zones, and the uniformity of the air distribution across the perforated surface area of the membrane 402 is made substantially uniform. Therefore, the efficiency of the gas transfer to the liquid is maximized by reason of the special arrangement of the slits 410 (or other perforations).

It should be understood that the perforations can take different forms and different shapes. Further, the number of zones can be varied and the sizes of the zones can be varied as desired or necessary.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A membrane structure for applying gas to a liquid, comprising:

a substantially cylindrical flexible membrane having a generally circular cross section and presenting at least a first zone occupying an arc substantially centered at a north pole location and a pair of second zones occupying arcs adjacent to opposite ends of said first zone; and a plurality of perforations in said first zone and each of said second zones for discharging gas from said membrane, said perforations in each of said second zones presenting a larger collective area as a percentage of the perforated surface area in each of said second zones than the collective area presented by said perforations in said first zone as a percentage of the surface area in said first zone.

2. A membrane structure as set forth in claim 1, wherein said perforations in each of said second zones are larger than the perforations in said first zone.

3. A membrane structure as set forth in claim 2, wherein said perforations in each of said second zones are more numerous per unit of surface area than said perforations in said first zone.

4. A membrane structure as set forth in claim 1, wherein said perforations in each of said second zones are more numerous per unit of surface area than said perforations in said first zone.

5. A membrane structure as set forth in claim 1, wherein:

said membrane includes a third zone occupying an arc substantially centered at a south pole location on the membrane; and said third zone includes a plurality of perforations presenting a larger collective area of perforations as a percentage of the perforated surface area in said third zone than the collective area of perforations presented by said perforations in each of said second zones as a percentage of the perforated surface area in each of said second zones.

6. A membrane structure as set forth in claim 1, wherein:

said membrane is imperforate on a lower portion thereof occupying an arc of approximately 180° centered at a south pole location on said membrane; and said first and second zones are located on an upper portion of said membrane, occupying an arc of approximately 180° centered on said north pole location.

7. A membrane structure as set forth in claim 6, wherein:

said zones include a pair of third zones occupying arcs adjacent to ends of the respective second zones on said upper portion of the membrane; and each of said third zones includes a plurality of perforations presenting a larger collective area of perforations as a percentage of the total perforated surface area in each of said third zones than the collective area of perforations presented by said perforations in each of said second zones as a percentage of the perforated surface area in each of said second zones.

8. A membrane structure as set forth in claim 1, wherein each of said perforations comprises an elongated slit, said slits in said second zones being longer than said slits in said first zone.

9. A membrane structure as set forth in claim 1, wherein:

said perforations comprise elongated slits arranged in separate rows of slits with the slits in each row spaced apart end to end;

said slits in each row have a selected length;

said slits in each row are spaced apart by a selected separation; and said rows are spaced apart by a selected row spacing.

10. A membrane structure as set forth in claim 9, wherein said slits in said second zones have a greater length than the slits in said first zone.

11. A membrane structure as set forth in claim 9, wherein said slits in said second zone, have a lesser separation than the slits in said first zone.

12. A membrane structure as set forth in claim 9, wherein said slits in said second zones have a lesser row spacing than the slits in said first zone.

13. A tubular membrane diffuser for applying gas to a liquid, comprising:

a rigid diffuser body having a substantially cylindrical shape for receiving the gas and at least one port for discharging the gas;

a flexible membrane sleeved onto said diffuser body, said membrane being substantially circular in cross section and presenting at least a first zone occupying an arc substantially centered at a north pole location and a pair of second zones occupying arcs adjacent to opposite ends of said first zone; and a plurality of perforations in said first zone and each of said second zones for discharging gas from said membrane, said perforations in each of said second zones presenting a larger collective area of perforations as a percentage of the perforated surface area in each of said second zones than the collective area of perforations presented by said perforations in said first zone as a percentage of the perforated surface area in said first zone.

14. A diffuser as set forth in claim 13, wherein:

said membrane includes a third zone occupying an arc substantially centered at a south pole location on the membrane; and said third zone includes a plurality of perforations presenting a larger collective area of perforations as a percentage of the perforated surface area in said third zone than the collective area of perforations presented by said perforations in each of said second zones as a percentage of the perforated surface area in each of said second zones.

15. A diffuser as set forth in claim 13, wherein:

said membrane is imperforate on a lower portion thereof occupying an arc of approximately 180° centered on said south pole location; and said first and second zones are located on an upper portion of said membrane, occupying an arc of approximately 180° centered on said north pole location.

16. A diffuser as set forth in claim 15, wherein:

said zones include a pair of third zones occupying arcs adjacent to ends of the respective second zones on said upper portion of the membrane; and each of said third zones includes a plurality of perforations presenting a larger collective area of perforations as a percentage of the perforated surface area in each of said third zones than the collective area of perforations presented by said perforations in each of said second zones as a percentage of the perforated surface area in each of said second zones.

17. A diffuser as set forth in claim 13, wherein:

said perforations comprise elongated slits arranged in separate rows of slits with the slits in each row spaced apart end to end;

said slits in each row have a selected length;

said slits in each row are spaced apart by a selected separation; and said rows are spaced apart by a selected row spacing.

18. A diffuser as set forth in claim 17, wherein said slits in said second zones have a greater length than the slits in said first zone.

19. A diffuser as set forth in claim 17, wherein said slits in said second zones have a lesser separation than the slits in said first zone.

20. A diffuser as set forth in claim 17, wherein said slits in said second zones have a lesser row spacing than the slits in said first zone.

* * * * *